United States Patent [19]

Slover

[11] Patent Number: 4,774,015

[45] Date of Patent: Sep. 27, 1988

[54] CARBURETOR CLEANER

[75] Inventor: Archy F. Slover, Arcadia, Calif.

[73] Assignee: Cherokee Chemical Co., Inc., Compton, Calif.

[21] Appl. No.: 834,389

[22] Filed: Feb. 28, 1986

[51] Int. Cl.[4] ..... C11D 9/30

[52] U.S. Cl. ..... 252/111; 252/109; 252/110; 252/527; 252/135; 252/139; 252/156; 252/158

[58] Field of Search ..... 252/111, 109, 110, 527, 252/139, 135, 156, 158

[56] References Cited

U.S. PATENT DOCUMENTS

| | | | |
|---|---|---|---|
| 2,551,634 | 5/1951 | Price . | |
| 2,901,433 | 7/1953 | Spring . | |
| 2,952,637 | 9/1960 | Bray et al. . | |
| 3,216,945 | 11/1965 | Mankowich . | |
| 3,275,561 | 9/1966 | Pye et al. . | |
| 3,360,471 | 12/1967 | Kwiatkowski . | |
| 3,528,922 | 9/1970 | Wagner | 252/109 |
| 3,723,328 | 3/1973 | Pelizza . | |
| 3,806,460 | 4/1974 | Mukai et al. . | |
| 3,882,038 | 5/1975 | Clayton et al. . | |
| 4,414,128 | 11/1983 | Goffinet | 252/111 |
| 4,613,446 | 9/1986 | Magyar | 252/110 |

*Primary Examiner*—Josephine Barr

*Attorney, Agent, or Firm*—Fulwider, Patton, Rieber, Lee & Utecht

[57] ABSTRACT

The invention is a carburetor cleaner containing ingredients which are not listed as hazardous by the Director of the California Department of Industrial Relations. Said cleaner comprises water, sodium meta silicate, trisodium phosphate, the tetrasodium salt of ethylene diamine tetraacetic acid, sodium or potassium hydroxide, tall oil fatty acids, a synthetic detergent, and butyl carbitol.

2 Claims, No Drawings

CARBURETOR CLEANER

BACKGROUND OF THE INVENTION

Conventional carbutor cleaners generally contain chlorinated hydrocarbons, such methylene chloride, phenols and other organic solvents. These materials are listed in "The Director's List of Hazardous Substances" published by the Director of the Department of Industrial Relations for the State of California, October 1982. These materials are hazardous to health and pose a problem with respect to the handling and disposal of carburetor cleaners containing such materials.

It is therefore desirable to provide a carburetor cleaner containing materials which are not classified as hazardous, and which is relatively safe to handle and dispose of.

SUMMARY OF THE INVENTION

The carburetor cleaner of the present invention consists of a combination of ingredients, none of which is classified as hazardous and which are found to compare favorably with the prior art carburetor cleaners in terms of rate of cleaning. The rate of cleaning of the present invention is surprising because there is nothing to suggest that the particular combination employed thereby would produce satisfactory results.

The carburetor cleaner of the present invention consists essentially of an aqueous mixture of about 0.5 to about 1.5 percent of sodium metasilicate, about 0 to about 1.75 percent of trisodium phosphate, about 0 to about 1.5 percent of the tetrasodium salt of ethylene diamine tetraacetic acid, about 0.5 to about 1.2 percent of a 50 percent aqueous solution of sodium or potassium hydroxide, about 1 to about 2 percent of tall oil fatty acids, about 2 to about 6 percent of a detergent, and about 10 to about 15 percent of butyl carbitol. The aforesaid percentages are weight percents of the total mixture, with water being added to bring the total to 100 percent.

The preferred formulation which has been found to give optimum results, comprises an aqueous mixture of about 1 percent sodium metasilicate, about 1 percent trisodium phosphate, about 0.5 percent of the tetrasodium salt of ethylene diamine tetracetic acid, about 1 percent of a 50 percent aqueous solution of potassium hydroxide, about 1.7 percent of tall oil fatty acids, about 4% of a detergent, and about 12 percent butyl carbitol. Said percentages are weight percentages with water added to total 100 percent.

Sodium metasilicate may be used either in anhydrous or crystalline form. The preferred crystalline form is sodium metasilicate pentahydrate, and if used, comprises about 0.9 to about 2.6 weight percent or a preferred amount of 2 percent in the aforesaid formulations.

Trisodium phosphate may also be used either in anhydrous or crystalline form. The preferred crystalline form has 12 water molecules attached thereto and is used in amounts which range from 0.0 to about 4 weight percent, or preferably 2.5 weight percent in the above formulations. Other related complex phosphates may be substituted for tri sodium phosphate, but they generally yield lower alkalinity and would eventually convert to the ortho form.

The tetrasodium salt of ethylene diamine tetraacetic acid is preferred, but other equivalent salts may be substituted.

The preferred synthetic detergents are "Monateric CEM 38", manufactured by Mona Industries of Paterson, N.J. This product is a 38 percent active coco amphopropionate. Another preferred detergent is "Miranol C 2MSF", manufactured by Miranol Chemical Co., Inc. of Dayton, N.J. This product is a 39 percent active disodium salt of a carboxylic coconut derivative.

While the embodiments of the invention set forth herein for purposes of disclosure are considered to be preferred, it is to be understood that this invention is intended to cover all changes and modifications in the disclosed embodiments which fall within the spirit and scope of the invention.

I claim:

1. A cleaner for automotive parts including carburetors consisting essentially of an aqueous mixture of
   - about 0.5 to about 1.5 percent sodium metasilicate,
   - about 0 to about 1.75 percent of trisodium phosphate,
   - about 0 to about 1.5 percent of the tetrasodium salt of ethylene diamine tetraacetic acid,
   - about 0.5 to about 1.2 percent of a 50 percent aqueous solution of sodium or potassium hydroxide,
   - about 1 to about 2 percent of tall oil fatty acids,
   - about 2 to about 6 percent of a synthetic detergent,
   - about 10 to about 15 percent of diethylene glycol monobutylene,
   - and water to bring the total of said mixture to 100%, said percentages being weight percents of the total mixture.

2. A carburetor cleaner consisting essentially of an aqueous mixture of
   - about 1 percent of sodium metasilicate,
   - about 1 percent of trisodium phosphate,
   - about 0.5 percent of the tetrasodium salt of ehtylene diamine tetraacetic acid,
   - about 1 percent of a 50 percent aqueous solution of sodium or potassium hydroxide,
   - about 1.7 percent of tall oil fatty acids,
   - about 4 percent of a synthetic detergent,
   - about 12 percent of diethylene glycol monobutylether,
   - and water to bring the total of said mixture to 100%, said percentages being weight percentages of the total mixture.

* * * * *